United States Patent [19]

Wang

[11] Patent Number: 5,043,696

[45] Date of Patent: Aug. 27, 1991

[54] STRUCTURE OF PASSIVE ELECTRIC CONNECTOR WITH BNC TERMINAL PLUG

[76] Inventor: Tsan-Chi Wang, No. 13, Aly. 312, Chung Cheng Rd., Hsin Tien City, Taiwan

[21] Appl. No.: 574,163

[22] Filed: Aug. 29, 1990

[51] Int. Cl.[5] ..... H01C 13/00

[52] U.S. Cl. ..... 338/220; 338/232; 338/277; 439/620; 333/260; 174/35 R; 174/35 C

[58] Field of Search ..... 338/77, 220, 221, 230, 338/232, 233, 277; 439/620, 578, 579; 333/260, 35 R, 35 C; 174/52.1, 50.52, 59, 60, 35 GC

[56] References Cited

U.S. PATENT DOCUMENTS

| | | | |
|---|---|---|---|
| 1,047,742 | 12/1912 | Buchanan | 338/232 |
| 3,107,132 | 10/1963 | Smith | 174/59 X |
| 3,617,811 | 11/1971 | McVoy | 174/59 X |
| 3,629,662 | 12/1971 | Cattey et al. | 338/220 X |
| 4,139,817 | 2/1979 | Boer et al. | 338/220 X |
| 4,567,318 | 1/1986 | Shu | 174/35 GC |
| 4,575,694 | 3/1986 | Lapke et al. | 338/220 X |

*Primary Examiner*—Marvin M. Lateef

*Attorney, Agent, or Firm*—Varndell Legal Group

[57] ABSTRACT

A passive electric connector with BNC terminal plug, which includes a metal casing releasably covered with a metal cover board with a BNC terminal plug connected thereto by a chain. The metal casing is integrally formed with four BNC sockets through casting process, which BNC sockets are partly projecting out of the metal casing and have each a center shaft extending inside the metal casing with a resistor respectively secured thereto. The resistors which have each an one respectively connected to the center shafts of the four BNC sockets are respectively connected together. The BNC terminal plug has an internal cylindrical cap and an external insulator cap to effectively protect against radio frequency interference and electrical magnetic interference. A marking is made on the external insulator cap for identification of a pull-down resistor received inside the BNC terminal plug.

1 Claim, 3 Drawing Sheets

STRUCTURE OF PASSIVE ELECTRIC CONNECTOR WITH BNC TERMINAL PLUG

BACKGROUND OF THE INVENTION

The present invention is related to a structure of passive electric connector with BNC terminal plug for use in computer network to connect signal transmission lines, which can effectively protect against radio frequency interference, electric magnetic interference and electric induction.

Recently information and data processing industry has been greatly promoted. High quality and high performance of computers and the relative peripheral equipments are commonly required. In computer network, passive electric connector is one of the important component parts. There is a type of passive electric connector generally comprising a metal casing with BNC (bayonet navy connector) sockets fastened therein and fixedly secured thereto through welding connection or by lock nut. Inside the casing, plastic packing material is stuffed to reinforce the structure. The casing may also covered with a layer of covering for the purpose of beauty. After resistors are connected, a bottom covered is attached to the metal or plastic casing. Disadvantages of this conventional type of passive electric connector are numerous and outlined hereinafter.

1) It is expensive to manufacture due to its complicated structure.

2) It is difficult to inspect in case of operational failure.

3) The BNC sockets may be loosened easily due to repeatedly mounting and dismounting of BNC terminal plugs through swivel joint.

4) A metal casing is not completely enclosed which can not effectively protect against external noise interference.

Conventionally, a regular BNC terminal plug generally comprises a metal socket for holding component parts and having inner thread at the top for fastening a circular cap which has a resistor welded inside. Disadvantages of this type of BNC terminal plug are numerous and outlined hereinafter.

1) In a computer network any terminal which is not in use must be connected with a terminal plug to block out any possible transmission of radio frequency waves so as to prevent interference with computer operation, i.e. to eliminate any possible so-called electronic pollution.

2) This type of metal terminal plug can not effectively eliminate radio frequency interference and may cause electric induction problems.

3) The complicated procedure to tap an inner thread on a socket of a terminal plug and weld a resistor to a circular cap inevitably complicate manufacturing process and relatively increase manufacturing cost.

4) Because there is no indication on the ohmic resistance of the resistor fastened in a terminal plug, misuse of a terminal plug may negatively affect a computer network.

SUMMARY OF THE INVENTION

One of the object of the present invention is to provide a passive electric connector which is inexpensive to manufacture, easy to inspect and repair and can effectively protect against noise interference.

Another object of the present invention is to provide a BNC terminal plug which can effectively protect against noise interference and electric induction.

Still another object of the present invention is to provide a connecting chain to secure a BNC terminal plug to a passive electric connector which can be simultaneously used for grounding.

BRIEF DESCRIPTION OF THE DRAWINGS

The present invention will now be described by way of example with reference to the annexed drawings, in which.

DETAILED DESCRIPTION OF THE PREFERRED EMBODIMENT

Figure 1:
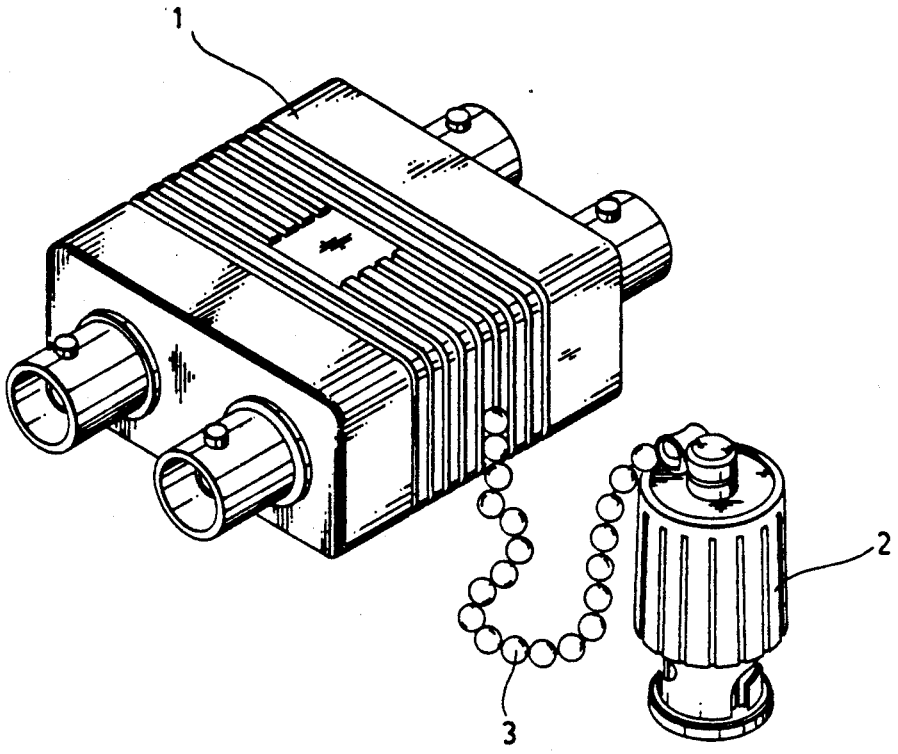
FIG. 1 is a perspective view of a passive electric connector embodying the present invention.

Turning now to the annexed drawings in greater detail and referring first to FIG. 1, therein illustrated is a passive electric connector embodying the present invention and generally comprised of a metal housing 1, a terminal plug 2, and a chain 3 connected therebetween.

Figure 2:
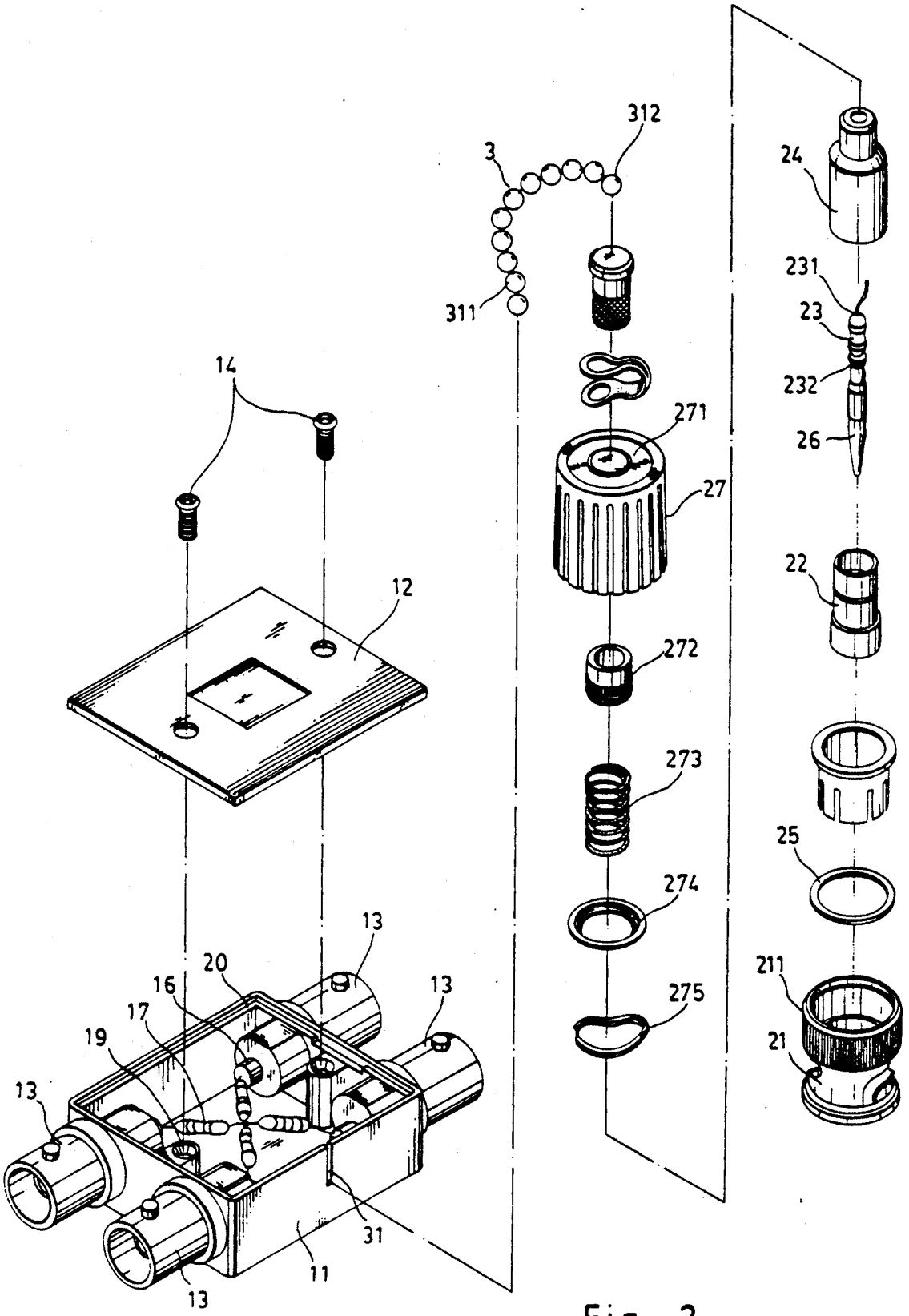
FIG. 2 is a perspective fragmentary view thereof.
Figure 3:
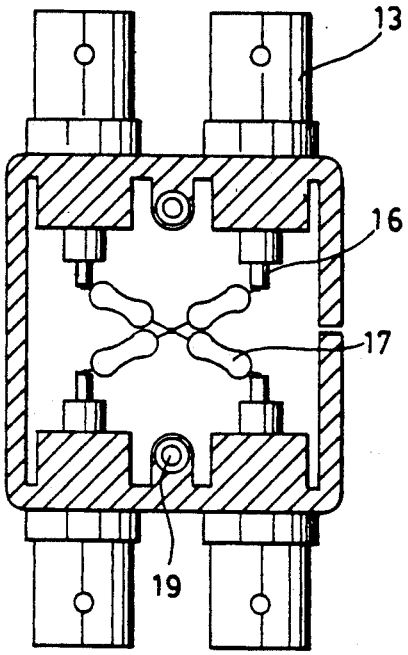
FIG. 3 is a transversely sectional view thereof.

Referring to FIGS. 2 and 3, the metal housing 1 comprises a casing 11 having a metal cover board 12 covered thereon and fixedly secured thereto by screws 14. The metal casing 11 comprises integrally two pairs of unitary BNC sockets 13 at two opposite ends.

Referring to FIG. 2 again, the metal casing 11 and the four BNC sockets 13 are unitarily formed of zinc alloy through casing process. Therefore, no welding connection is required to secure the BNC sockets 13 to the casing 11 and the BNC sockets 13 do not break away from the casing 11. An endless channel 20 is made on the topmost edge of the metal casing at an inner side for mounting the metal cover board 12. After the metal cover board 12 is covered on the metal casing 11 and fixedly secured thereto by screws 14, the metal casing 11 becomes tightly sealed to protect against possible noise interference. The metal cover board 12 can be conveniently removed from the metal casing 11 for inspecting internal component parts when it is required. Four BNC shafts 16 are respectively fastened in the four BNC sockets 13 for connecting four resistors 17 respectively. Referring to FIG. 4, the four resistors 17 are disposed inside the metal casing 11, having each one end connected to the BNC shafts 16 and an opposite end connected together. Inside the metal casing 11 there are raised bolt holes 19 for fastening the screws 14 which are respectively inserted through the metal cover board 12 to secure the metal cover board 12 in the endless groove 20. There is a narrow opening 31 made on the metal casing 11 at one side for fastening a chain 3 which is to secure a BNC terminal plug 2 to the metal casing 11.

Referring to FIG. 2 again, a BNC terminal plug 2 of the present invention comprises a socket-like holder member 21 for mounting in proper order a plurality of fastening elements 25, a rubber bush 22, a pull-down resistor 23, a cylindrical cap 24, elements 275, 274, 273, 272 and then covered with a cylindrical cap 27. The resistor 23 has a terminal attached to its lower end 232 and inserted in the rubber bush 22, and a conductor 231 at an opposite end and inserted through the cylindrical cap 24. The holder member 21 has a plurality of embossed strips 211 vertically made around its periphery so that the cylindrical outer cap 27 can be firmly secured thereto when it is pressed to cover thereon. The cylindrical outer cap 27 comprises a closed top edge 271 embossed with a marking for indication of the ohmic resistance of the resistor 23. The chain 2 has one end 311 fastened in the narrow opening 31 of the metal casing 11 and an opposite end 312 fastened in the cylindrical outer cap 27. Therefore, the BNC terminal plug 2 is secured from missing. When the BNC terminal plug 2 is fastened in either of the BNC socket 13, the chain 3 is simultaneously used for grounding.

Because the rubber bush 22 is fastened in the cylindrical cap 24 to protect the resistor 23 therein and the cylindrical outer cap 27 is made of insulating material and mounted on holder member 21 and engaged with the embossed strips 211, external radio frequency interference or electric induction problems can be efficiently eliminated.

The above drawings and description are for the purpose of illustration only and not intended as a definition of the limits and scope of the invention disclosed. Recognizing that various modifications been apparent, the scope herein shall be deemed as defined in the claim as set forth hereinafter.

I claim:

1. A passive electric connector with BNC terminal plug, comprising:

a metal housing comprising a metal casing having a metal cover board releasably covered thereon, said metal casing comprising integrally two pairs of unitary BNC sockets at two opposite ends and formed through casting process, said BNC sockets being partly projecting out of said metal casing and having each a center shaft extending inside said metal casing;

four resistors fastened inside said metal casing, having each one end respectively connected to the center center shaft of one of said BNC sockets and an opposite end respectively connected together;

a BNC terminal plug comprising a socket-like holder member for mounting fastening elements, a rubber bush, a pull-down resistor, an inner cylindrical cap and covered with an external insulator cap, said external insulator cap being embossed with a marking for indication of the ohmic resistance of said pull-down resistor, said socket-like holder member having a plurality of embossed vertical strips around its periphery to reinforce its engaging force with said external insulator cap;

a chain having one end connected to said metal casing and an opposite end connected to said external insulator cap.

* * * * *